US006486595B1

(12) United States Patent
Gagnon et al.

(10) Patent No.: US 6,486,595 B1
(45) Date of Patent: Nov. 26, 2002

(54) ELECTRIC LAMP HAVING PRESS SEAL CONFIGURATION FOR EXHAUST TUBE PROTECTION

(75) Inventors: Mitchell R. Gagnon, Hooksett, NH (US); William L. Kretovic, Concord, NH (US); Michael T. Ford, Deering, NH (US); Arnold R. Cernota, Greenfield, NH (US); Gregory Bibbo, Bow, NH (US)

(73) Assignee: Osram Sylvania Inc., Danvers, MA (US)

( * ) Notice: Subject to any disclaimer, the term of this patent is extended or adjusted under 35 U.S.C. 154(b) by 247 days.

(21) Appl. No.: 09/596,777

(22) Filed: Jun. 19, 2000

(51) Int. Cl.[7] ..... H01J 5/50

(52) U.S. Cl. ..... 313/318.01; 313/318.07; 313/623

(58) Field of Search ..... 313/318.01, 318.07, 313/623, 315, 316, 578, 580; 439/617

(56) References Cited

U.S. PATENT DOCUMENTS

| | | | | |
|---|---|---|---|---|
| 3,551,725 A | | 12/1970 | Brundige | 313/318 |
| 3,857,056 A | | 12/1974 | Miller | 313/318 |
| 4,469,983 A | * | 9/1984 | Grahmann et al. | 313/318 |
| 4,603,278 A | | 7/1986 | Devir et al. | 313/318 |
| 4,752,710 A | | 6/1988 | Devir et al. | 313/318 |
| 4,877,992 A | | 10/1989 | Devir | 313/318 |
| 4,979,082 A | | 12/1990 | Devir | 362/226 |
| 5,008,588 A | | 4/1991 | Nakahara | 313/318 |
| 5,061,873 A | | 10/1991 | Belliveau | 313/271 |
| 5,105,119 A | * | 4/1992 | Dayton | 313/318 |
| 5,186,669 A | | 2/1993 | Holman et al. | 445/16 |
| 5,278,741 A | | 1/1994 | Ehrman | |
| 6,056,417 A | | 2/2000 | Cheng | |
| 6,232,707 B1 | * | 5/2001 | Ranish et al. | 313/318.01 |

FOREIGN PATENT DOCUMENTS

| | | |
|---|---|---|
| EP | 415 483 A1 | 3/1991 |
| EP | 924 745 A2 | 6/1999 |

* cited by examiner

*Primary Examiner*—Robert H. Kim
*Assistant Examiner*—Jurie Yun
(74) *Attorney, Agent, or Firm*—William E. Meyer

(57) ABSTRACT

An electric lamp includes a light-transmissive lamp envelope defining an enclosed volume, the lamp envelope having a press seal at one end thereof and the press seal having a recess along a bottom edge thereof, at least one lamp filament disposed in the enclosed volume of the lamp envelope, electrical leads extending through the press seal on opposite sides of the recess and connected to the lamp filament, and an exhaust tube extending through the recess in the press seal to the enclosed volume of the lamp envelope. An insulating base is typically secured to the press seal. The exhaust tube located in the recess is at least partially shielded against breakage.

18 Claims, 2 Drawing Sheets

ELECTRIC LAMP HAVING PRESS SEAL CONFIGURATION FOR EXHAUST TUBE PROTECTION

FIELD OF THE INVENTION

This invention relates to electric lamps and, more particularly, to electric lamps wherein the lamp envelope is sealed with a press seal, and an exhaust tube extends through the press seal.

BACKGROUND OF THE INVENTION

One common type of incandescent electric lamp is a so-called S-8 wedge type lamp used for automobile brake light, turn signal and tail light applications. Such lamps typically include one or more filaments located within a lamp envelope. Electrical leads extend through a press seal for connection to an energy source. In addition, an exhaust tube extends through the press seal to the enclosed volume of the lamp envelope. The exhaust tube is used to fill the enclosed volume of the lamp envelope with a desired gas fill after formation of the press seal. The exhaust tube is then tipped off, or sealed, by heating the glass tube. The lamp is mounted in a plastic base that attaches to the press seal. A lamp assembly, including the lamp and the base, is inserted into a socket in the automobile or other vehicle.

Current lamps of this type have an elongated exhaust tube that extends beyond the press seal. It has been found that the current lamp configuration with an elongated exhaust tube is somewhat fragile and can fail upon incorrect insertion into the lamp socket. Recently, wedge lamp usage has shifted to automatic insertion techniques. This process has resulted in increased lamp failures upon insertion, due to off-axis insertion of the lamp assembly into the socket, allowing the press seal to pivot inside the base. The exposed exhaust tube contacts the inside wall of the plastic base and temporarily carries the insertion force load. A result of this type of loading may be a mechanical failure of the exhaust tube. The failure upon incorrect insertion may not be detected until a later time.

Wedge-type incandescent electric lamps which utilize an insulating base are disclosed, for example, in U.S. Pat. No. 4,603,278, issued Jul. 29, 1986 to Devir et al.; U.S. Pat. No. 4,752,710, issued Jun. 21, 1988 to Devir et al.; U.S. Pat. No. 4,877,992, issued Oct. 31, 1989 to Devir; U.S. Pat. No. 4,979,082, issued Dec. 18, 1990 to Devir; U.S. Pat. No. 5,008,588, issued Apr. 16, 1991 to Nakahara; U.S. Pat. No. 5,061,873, issued Oct. 29, 1991 to Belliveau; U.S. Pat. No. 5,186,669, issued Feb. 16, 1993 to Holman et al; U.S. Pat. No. 5,278,741, issued Jan. 11, 1994 to Ehrman; and U.S. Pat. No. 6,056,417 issued May 2, 2000 to Cheng. None of the prior art known to Applicants has addressed the breakage problem described above.

Accordingly, there is a need for electric lamps having press seal configurations which provide exhaust tube protection and for methods of making such electric lamps.

SUMMARY OF THE INVENTION

According to a first aspect of the invention, an electric lamp is provided. The lamp comprises a light-transmissive lamp envelope defining an enclosed volume, the lamp envelope having a seal and the seal having a recess, a light source disposed in the enclosed volume of the lamp envelope, electrical leads extending through the seal and connected to the light source, and an exhaust tube extending through the recess in the seal to the enclosed volume of the lamp envelope. The seal preferably comprises a press seal.

The exhaust tube includes an exposed portion external to the press seal. A substantial part of the exposed portion of the exhaust tube is positioned within the recess, so that the exhaust tube is at least partially shielded against breakage. The exposed portion of the exhaust tube external to the press seal may have a length that is less than the length of the press seal. The exhaust tube may have an outside diameter that is less than the thickness of the press seal for further shielding of the exhaust tube.

According to another aspect of the invention, a lamp assembly is provided. The lamp assembly comprises an electric lamp and a lamp base. The electric lamp may be configured as described above. The lamp base is secured to the press seal.

According to a further aspect of the invention, a method is provided for making an electric lamp. The method comprises the steps of providing a light-transmissive lamp envelope having an interior volume and an opening communicating with the interior volume, positioning a filament assembly and an exhaust tube in the opening, heating the lamp envelope at least in the region of the opening, forming the lamp envelope into a press seal such that electrical leads of the filament assembly and the exhaust tube extend through the press seal into the interior volume of the lamp envelope, and pushing the exhaust tube toward the interior volume of the lamp envelope with the lamp envelope heated to form a recess in the press seal where the exhaust tube extends into the lamp envelope.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
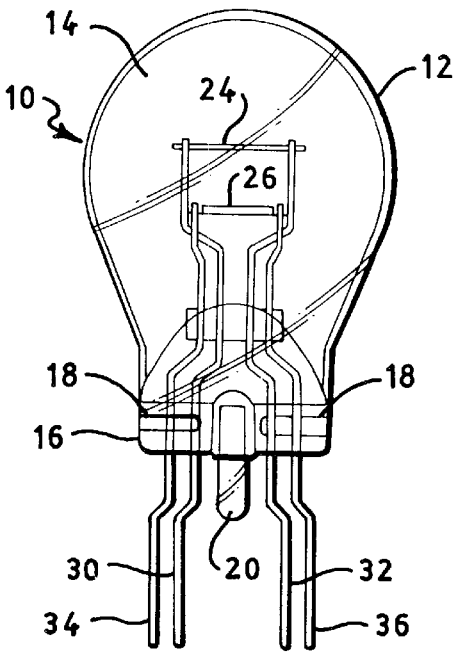
FIG. 1 (PRIOR ART)
FIG. 1 is a front view of a prior art wedge-type electric lamp.
Figure 2:
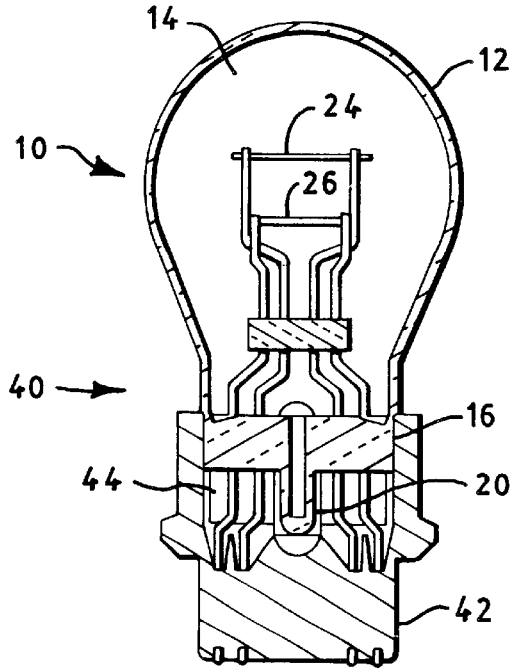
FIG. 2 (PRIOR ART)
FIG. 2 is a front view of a lamp assembly incorporating the electric lamp of FIG. 1.
Figure 3:
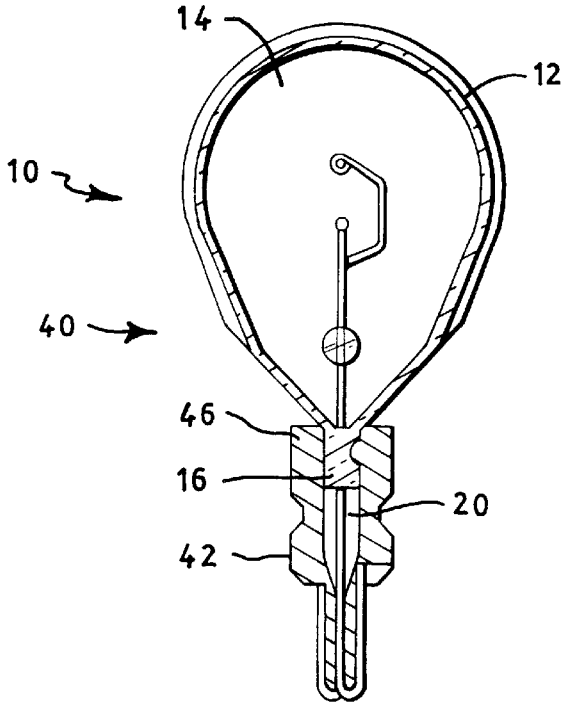
FIG. 3 (PRIOR ART)
FIG. 3 is a side view of the lamp assembly of FIG. 2.

A prior art wedge-type lamp is shown in FIG. 1. A lamp assembly incorporating the lamp of FIG. 1 is shown in FIGS. 2 and 3. A lamp 10 includes a lamp envelope 12 that defines an enclosed volume 14. Lamp envelope 12 is closed at one end by a press seal 16 having locating grooves 18. An exhaust tube 20 extends through press seal 16 to enclosed volume 14. In the completed lamp, exhaust tube 20 is sealed at its outer end. Filaments 24 and 26 are mounted within lamp envelope 12. Electrical leads 30 and 32 extend through press seal 16 and are connected to filament 24. Electrical leads 34 and 36 extend through press seal 16 and are connected to filament 26.

A lamp assembly 40 including lamp 10 and an insulating base 42 is shown in FIGS. 2 and 3. Insulating base 42 is typically a plastic element that has a cavity 44 for receiving press seal 16, exhaust tube 20 and electrical leads 30, 32, 34 and 36 of lamp 10. Base 42 is secured to press seal 16 to form lamp assembly 40. Base 42 may include projections 46 that engage locating grooves 18 in press seal 16, so as to locate base 42 relative to lamp envelope 12.

In use, lamp assembly 40 is inserted into a lamp socket in an automobile or other vehicle. The insertion process may be manual or automatic. In either case, lateral forces may be applied to the lamp assembly, causing lamp 10 to pivot relative to base 42. This may cause exhaust tube 20 to contact the inside wall of cavity 44 in base 42, often resulting in breakage of exhaust tube 20 and failure of lamp 10.

Figure 4:
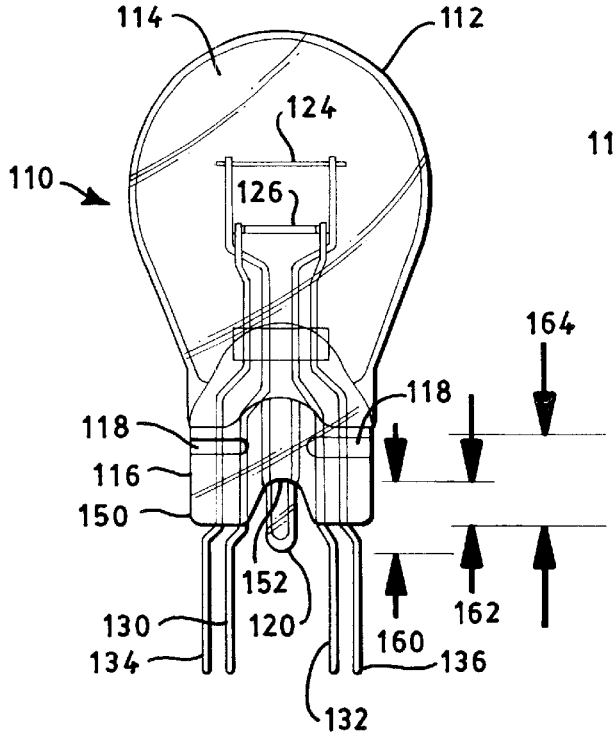
FIG. 4 is a front view of an electric lamp in accordance with an embodiment of the invention.
Figure 5:
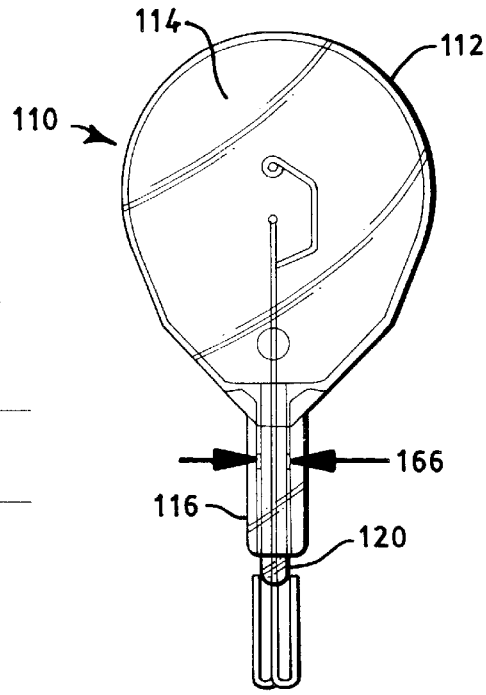
FIG. 5 is a side view of the electric lamp of FIG. 4.
Figure 6:
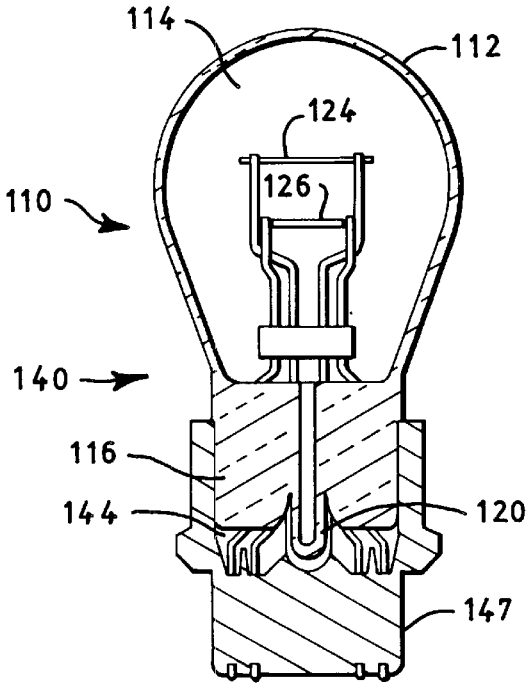
FIG. 6 is a front view of a lamp assembly incorporating the lamp of FIG. 4.
Figure 7:
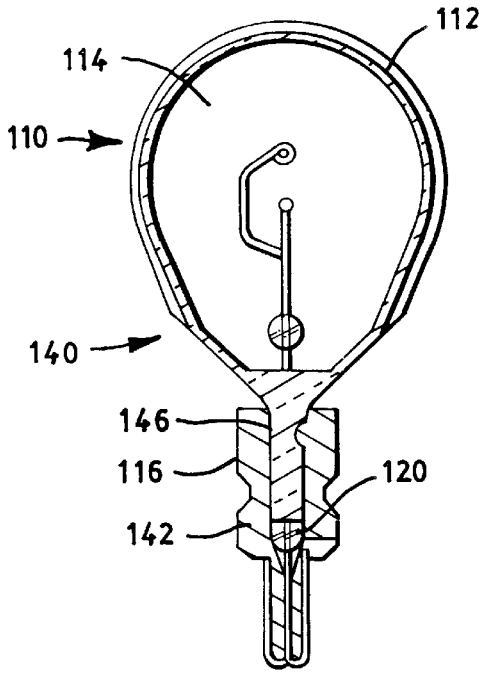
FIG. 7 is a side view of the lamp assembly of FIG. 6.

A lamp 110 in accordance with an embodiment of the invention is shown in FIGS. 4 and 5. A lamp assembly incorporating lamp 110 is shown in FIGS. 6 and 7. Lamp 110 includes a lamp envelope 112 which defines an enclosed volume 114. One end of lamp envelope 112 is closed by a press seal 116. Press seal 116 may be provided with lateral grooves 118 for locating lamp 110 relative to a base. An exhaust tube 120 extends through press seal 116 to enclosed volume 114. In the completed lamp, exhaust tube 120 is sealed at its outer end.

Filaments 124 and 126 are positioned within the enclosed volume 114 of lamp envelope 112. Electrical leads 130 and 132 extend through press seal 116 and are connected to filament 124. Electrical leads 134 and 136 extend through press seal 116 and are connected to filament 126. Electrical leads 130, 132, 134 and 136 conduct electrical current to filaments 124 and 126 and provide mechanical support for filaments 124 and 126 within lamp envelope 112. It will be understood that a single filament or more than two filaments may be utilized within the scope of the invention.

A lamp assembly 140 incorporating lamp 110 and an insulating base 142 is shown in FIGS. 6 and 7. Insulating base 142 is provided with a cavity 144 for receiving press seal 116, exhaust tube 120 and electrical leads 130, 132, 134 and 136 of lamp 110. Insulating base 142, typically fabricated of plastic, is secured to press seal 116 to form lamp assembly 140. Base 142 may be provided with projections 146 which engage grooves 118 in press seal 116 and which locate base 142 relative to lamp 110.

As shown in FIG. 4, electrical leads 130, 132, 134, and 136 emerge from press seal 116 at a lower edge 150 of press seal 116. Press seal 116 is formed with a recess 152 along lower edge 150. Recess 152 extends inwardly toward enclosed volume 114. Exhaust tube 120 emerges from press seal 116 in recess 152 and is thereby partially shielded from external mechanical forces. By positioning exhaust tube 120 within recess 152, exhaust tube 120 is more protected against breakage than in the lamp configuration shown in FIG. 1 and described above. It has been found that simply shortening the length of the exposed portion of exhaust tube 120 does not provide satisfactory results. In particular, when the exhaust tube is heated for tip off following introduction of the desired fill gas into enclosed volume 114, thermal transients may cause breakage of exhaust tube 120 at the region where it emerges from press seal 116. For this reason, the minimum length of exposed portion of exhaust tube 120 is limited. In one example, the exposed portion of exhaust tube 120 has a length 160 of 0.180 inch, and recess 152 has a depth 162 of 0.080 inch in a lamp assembly having an overall length of 2.06 inches. Thus, exhaust tube 120 is at least partially shielded against breakage within recess 152 in press seal 116.

As shown in FIG. 4, exhaust tube 120 and recess 152 are preferably located at the center of the lower edge 150 of press seal 116 and are located between electrical leads 130 and 134 on one side and electrical leads 132 and 136 on the opposite side. However, the invention is not limited to this configuration, and exhaust tube 120 and recess 152 may have any desired location on press seal 116.

Additional features of the lamp 110 result in reduced risk of breakage. In particular, a length 164 of press seal 116 is increased in comparison with prior art lamps. In the example described above, press seal 116 has a length 164 of 0.245 inch. Thus, the length 164 of press seal 116 is greater than the length 160 of the exposed portion of exhaust tube 120. In addition, the outside diameter of exhaust tube 120 is preferably less than a thickness 166 of press seal 116 in order to shield the exposed portion of exhaust tube 120 from external mechanical forces. In the above example, exhaust tube 120 has an outside diameter of 0.100 inch, and press seal 116 has a thickness 166 of no less than 0.107 inch. The thickness 166 of press seal 116 is selected to deter movement of lamp 110 relative to base 142.

Lamp 110 may be fabricated, for example, by the following process. A lamp envelope having an opening communicating with an interior volume is provided. A filament assembly, including filaments 124 and 126 attached to the respective electrical leads 130, 132, 134 and 136, is positioned in the opening, with filaments 124 and 126 located within the lamp envelope and electrical leads 130, 132, 134 and 136 extending to the exterior of the lamp envelope. In addition, exhaust tube 120 is positioned in the opening, of the lamp envelope to permit communication with the interior volume of the lamp envelope after formation of the press seal. Then, the lamp envelope is heated in the region of the opening, and a press seal is formed using known press sealing techniques. While the press seal is heated to a plastic state, exhaust tube 120 is pushed inwardly along its axis toward filaments 124 and 126, thereby deforming the press seal and producing recess 152 in the lower edge 150 of press seal 116. The press seal is allowed to cool. Then, the desired gas fill is introduced into enclosed volume 114 through exhaust tube 120. Exhaust tube 120 is tipped off by heating it at the desired tip off location to cause sealing and to permit removal of the excess length of exhaust tube 120.

Lamps of the type shown in FIGS. 4–7 and described above are commonly known as S-8 wedge-type lamps and are used for brake light, turn signal and tail light applications in automobiles and other vehicles. However, the present invention is not limited to these lamps.

Having thus described at least one illustrative embodiment of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed is:

1. A lamp comprising:

a light-transmissive lamp envelope defining an enclosed volume, said lamp envelope having a seal, said seal having a recess;

a light source disposed in the enclosed volume of the lamp envelope; and an exhaust tube extending through the recess in said seal to the enclosed volume of said lamp envelope;

wherein said seal comprises a press seal and wherein said exhaust tube has an outside diameter that is less than a thickness of said press seal.

2. A lamp as defined in claim 1 wherein said exhaust tube includes an exposed portion external to said press seal and wherein a substantial part of the exposed portion of said exhaust tube is disposed within said recess.

3. A lamp as defined in claim 1 wherein said exhaust tube includes an exposed portion external to said press seal and wherein a length of said exposed portion is less than a length of said seal.

4. A lamp as defined in claim 1 wherein said electrical leads are positioned on opposite sides of said recess.

5. A lamp as defined in claim 4 wherein said recess is located in a bottom edge of said seal.

6. A lamp as defined in claim 1 wherein said light source comprises a lamp filament and wherein said electrical leads comprise first and second leads coupled to said lamp filament.

7. A lamp as defined in claim 1 wherein said light source comprises first and second lamp filaments and wherein said electrical leads comprise a pair of electrical leads connected to each of said lamp filaments.

8. A lamp as defined in claim 1 configured as an S-8 wedge-type lamp.

9. A lamp as defined in claim 1 wherein said press seal has at least one groove formed therein for locating said lamp envelope relative to a lamp base.

10. A lamp assembly comprising:

an electric lamp comprising:

a light-transmissive lamp envelope defining an enclosed volume, said lamp envelope having a seal, said seal having a recess on a bottom edge thereof;

a light source disposed in the enclosed volume of said lamp envelope;

electrical leads extending through said press seal and connected to said light source; and an exhaust tube extending through the recess in said press seal to the enclosed volume of said lamp envelope; and a lamp base secured to said press seal, and wherein said exhaust tube has an outside diameter that is less than a thickness of said press seal.

11. A lamp assembly as defined in claim 10 wherein said exhaust tube includes an exposed portion external to said press seal and wherein a substantial part of the exposed portion of said exhaust tube is disposed within said recess.

12. A lamp assembly as defined in claim 10 wherein said exhaust tube includes an exposed portion external to said press seal and wherein the length of said exposed portion is less than the length of said press seal.

13. A lamp assembly as defined in claim 10 wherein said recess is located in a bottom edge of said press seal.

14. A lamp assembly as defined in claim 10 wherein said light source comprises first and second lamp filaments and wherein said electrical leads comprise a pair of electrical leads connected to each of said lamp filaments.

15. A lamp comprising:

a light-transmissive lamp envelope defining an enclosed volume, said lamp envelope having a press seal at one end thereof, said press seal having a recess along a bottom edge thereof;

at least one lamp filament disposed in the enclosed volume of said lamp envelope; electrical leads extending through said press seal on opposite sides of said recess and connected to said lamp filament; and an exhaust tube extending through the recess in said press seal to the enclosed volume of said lamp envelope, and wherein said exhaust tube has an outside diameter that is less than a thickness of said press seal.

16. A lamp as defined in claim 15, wherein said exhaust tube has an exposed portion external to said press seal and wherein a substantial part of the exposed portion of said exhaust tube is located within said recess.

17. A lamp as defined in claim 15, wherein said exhaust tube has an exposed portion external to said press seal and wherein the length of said exposed portion of said exhaust tube is less than the length of said press seal.

18. A method for making an electric lamp, comprising the steps of:

providing a light-transmissive lamp envelope having an interior volume and an opening communicating with said interior volume;

positioning a filament assembly having electrical leads and an exhaust tube in said opening;

heating the lamp envelope at least in the region of said opening;

forming said lamp envelope into a press seal such that said electrical leads and said exhaust tube extend through said press seal into the interior volume of said lamp envelope; wherein said exhaust tube has an outside diameter that is less than a thickness of said press seal, and pushing said exhaust tube toward the interior volume of said lamp envelope with said lamp envelope heated to form a recess in said press seal where said exhaust tube extends into said lamp envelope.

* * * * *